US009016020B1

(12) United States Patent
Yang

(10) Patent No.: US 9,016,020 B1
(45) Date of Patent: Apr. 28, 2015

(54) THIN BRICK PANEL ASSEMBLY SYSTEM

(71) Applicant: Jisong Yang, Burlington (CA)

(72) Inventor: Jisong Yang, Burlington (CA)

( * ) Notice: Subject to any disclaimer, the term of this patent is extended or adjusted under 35 U.S.C. 154(b) by 0 days.

(21) Appl. No.: 14/252,885

(22) Filed: Apr. 15, 2014

(51) Int. Cl.

| | |
|---|---|
| ***E04B 1/38*** | (2006.01) |
| ***E04F 13/14*** | (2006.01) |
| ***E04F 13/072*** | (2006.01) |
| ***E04F 13/21*** | (2006.01) |

(52) U.S. Cl.
CPC ..... *E04F 13/142* (2013.01); *E04F 13/072* (2013.01); *E04F 13/21* (2013.01)

(58) Field of Classification Search
CPC ... E04F 13/147; E04F 13/0803; E04F 13/185; E04F 2201/0517; E04F 19/024; E04C 2002/008
USPC ..... 52/506.5, 506.8, 772, 779, 314, 315, 52/316, 385, 386, 387
See application file for complete search history.

(56) References Cited

U.S. PATENT DOCUMENTS

| | | | | | |
|---|---|---|---|---|---|
| 2,087,931 | A | * | 7/1937 | Wallace et al. | 52/387 |
| 2,832,102 | A | * | 4/1958 | Amoruso | 52/386 |
| 3,073,420 | A | * | 1/1963 | Olsen | 52/506.06 |
| 4,238,915 | A | * | 12/1980 | Yoshida et al. | 52/510 |
| 4,553,366 | A | * | 11/1985 | Guerin | 52/506.08 |
| 4,809,470 | A | | 3/1989 | Bauer et al. | |
| 4,856,245 | A | * | 8/1989 | Osawa | 52/386 |
| 4,890,433 | A | * | 1/1990 | Funaki | 52/386 |
| 4,987,712 | A | * | 1/1991 | Mancuso | 52/387 |
| 5,228,937 | A | * | 7/1993 | Passeno | 156/299 |
| 6,421,974 | B1 | * | 7/2002 | Whitehouse et al. | 52/510 |
| 6,880,305 | B2 | * | 4/2005 | Pervan et al. | 52/480 |
| 7,997,039 | B2 | | 8/2011 | Wolf et al. | |
| 8,033,066 | B2 | * | 10/2011 | Griffiths | 52/235 |
| 8,359,811 | B2 | * | 1/2013 | Muller | 52/747.12 |
| 8,453,388 | B2 | * | 6/2013 | Neuhofer, Jr. | 52/36.5 |
| 2002/0178673 | A1 | * | 12/2002 | Pervan | 52/385 |
| 2003/0121225 | A1 | * | 7/2003 | Hunsaker | 52/314 |
| 2005/0166502 | A1 | * | 8/2005 | Pervan et al. | 52/387 |
| 2005/0252130 | A1 | * | 11/2005 | Martensson | 52/384 |
| 2008/0155921 | A1 | * | 7/2008 | Wolf et al. | 52/386 |
| 2008/0216444 | A1 | * | 9/2008 | Loyd | 52/742.16 |
| 2011/0047916 | A1 | * | 3/2011 | Muller | 52/477 |
| 2012/0317909 | A1 | * | 12/2012 | MacKenzie | 52/288.1 |

OTHER PUBLICATIONS

U.S. Appl. No. 07/680,058, filed Jul. 20, 1991, James Passeno.

* cited by examiner

*Primary Examiner* — Brian Glessner
*Assistant Examiner* — Gisele Ford
(74) *Attorney, Agent, or Firm* — Nasser Ashgriz; UI Patent

(57) ABSTRACT

Typical brick veneers are usually constructed aid of an adhesive and for attachment of the brick to a panel. The present invention allows for a mechanical installation of thin brick veneers using conventional brick materials and natural stone tiles. The present invention also allows for the construction of a water channel and a space for injecting foam insulation. The present invention allows for a quicker and simpler method of installation of brick veneer and reduces material costs while improving on conventional brick veneer functionality.

10 Claims, 10 Drawing Sheets

(a)

(b)

(c)

THIN BRICK PANEL ASSEMBLY SYSTEM

FIELD OF THE INVENTION

The present invention relates to thin stone or thin brick veneer wall systems and to clips for fastening facing elements thereof.

BACKGROUND OF THE INVENTION

Brick veneers are typically constructed by using thin bricks or a stone tiles and fastening them to a wall and panel with the aid of an adhesive. Brick veneer construction is often less costly than full brick construction because it does not require a skilled masonry tradesperson, it also does not necessary require the building of a foundation for support. Thin bricks for thin brick veneers can be made of stone, polymer materials or composites of polymer and cement. Others thin brick veneers are made by splitting cement blocks and dressing the front face. Polymers and polymer composites often lack the appeal of natural brick and may not be preferred by some customers because of aesthetic reasons. Cement thin bricks are more similar in appearance to natural stone bricks but quick construction of a thin brick veneer wall does require one to be knowledgeable in masonry methods.

Thin brick systems using adhesives may be less secure due to improper application. Additionally, over time some adhesives may not hold as well when exposed to certain weather conditions which can lead to loose or falling bricks.

There are a number of methods and devices of affixing thin brick veneers, however they often are complicated and do not provide any methods for water drainage. Some brackets and clips required for installing thin brick veneers require much time consuming work thereby negating the supposed quick and easy installation advantage of the thin brick veneer system.

Canadian patent CA 2526876 issued to Huff and Shouldice, discloses a thin brick system which clips to attach bricks to a wall. The system is comprised of two types of clips which are housed within a groove in the lower edge of the upper stone and within the groove of the upper edge of the lower stone. The system requires individual clips to be nailed to the wall. This system also does not contain a wall gap that can serve as a water channel on in which foam insulation can be sprayed. Additionally the bricks do not contain the different length extrusions that allow for fast mounting of the brick as in the present invention.

U.S. Pat. No. 4,809,470 issued to Bauer et al., discloses a structure and a method for construction of a brick facade. It comprises of a panel that is configured to secure bricks by using a friction fit and the rear surface of the brick is secured using an adhesive. The present invention does not use any adhesive materials in its implementation nor does it require the mounting of panel for installation of the bricks.

PCT/IB2004/050464 filed by Passeno, discloses a panel made of sheet material that has rows of spaced block support elements in the form of prongs. The blocks rest on the prongs and the gaps left by the blocks can be filled with mortar. This invention does not have the ability to be mounted to wooden studs to allow for a water channel or for a space to allow foam insulation to be sprayed. Additionally, the invention also requires a large panel to be fitted and installed unlike the present invention which uses C-bars which can be more easily fitted to differing wall lengths.

There is a need to improve thin brick veneer system so as that they do not require addition of adhesive materials and allow for a simple mechanical installation. Some of the disclosed prior art requires the use of adhesive to secure the bricks to the panel or wall. This steps requires additional materials and additional time for construction of the veneers. Other systems in the prior art require installation of large panels for which have to be sized and cut to fit the wall. This may be difficult and time consuming for large sized panels. Additionally, none of the systems in the prior art provides a means for constructing a water channel or space for the addition of foam insulation in its design. The present invention provides a quick method of mechanically attaching brick veneers that requires less material than previously. It also increases the functionality of thin brick veneers by adding a water channel and means for installing foam insulation.

SUMMARY OF THE INVENTION

The first objective of the invention is to provide a quick, efficient and inexpensive method of creating brick veneers. Most brick veneer systems require a type of adhesive or extensive methods for securing the brick to the wall or panel. The present invention uses a horizontal C-bar that can be fitted to a length of the wall to allow for bricks to be mechanically and easily placed.

The second objective of the present invention is to improve upon existing thin brick system so as to provide added insulation and the ability to improve water drainage. For this purpose, the present invention separates the brick veneer system from the wall with a series of wooden studs. The studs serve to secure the C-bar and provide a gap between the wall and the brick veneer. This gap can then be filled with foam insulation or left empty to serve as a water channel.

A third objective of the present invention is to provide a mechanical means of attaching natural stone or tiles. Another embodiment of the present invention has the C-bar edges oriented at a narrower angle which function to hold natural stone or tiles and has elements like grout or other filler in addition to cement that can be placed in the gaps of the tiles.

The present invention is a thin stone or thin brick wall system comprising: a plurality of stone or brick facing elements, a plurality of steel C-bars housed on wooden studs, the wooden studs being housed against a plywood board. The gap between the wooden studs can be used as a water channel or foam insulation can be sprayed into the gap. The C-bar is attached by nails to two wooden studs. The C-bars are horizontally separated approximately a brick height.

The thin bricks of the present invention have three grooves along the length of the brick. The bottom and top grooves have further extrusions or channels that aid in attaching the brick onto the C-bar. As the bricks are attached to the C-bar a consistent gap is created between each brick or tile. The gap between the bricks can be filled with cement or other type of filling material.

Other embodiments include using natural stone or tile instead of thin bricks. In this embodiment, the C-bar edges are designed at an angle that is less than 90 degrees. The appropriate stone or tile has grooves that match the angle of the C-bar edges for easier insertion.

The present invention has two general embodiments of the C-bar. A conventional steel C-bar which has an appropriate height that it is able to have attached two thin bricks. Its depth away from the wall is such that thin bricks can be flatly placed against it, and two edges of a differing length which are designed to hold the thin bricks. The top edge is of a shorter length than the bottom edge. The differing lengths of the two edges are designed so that a groove of the thin brick can easily fit the shorter edge, allow it to be raised and the bottom of the brick can be inserted into the lower edge of the upper C-bar and be held there.

The second C-bar is designed for either the top or bottom of the brick veneer. One end contains the long edge as described above and the other end is flat so as to support the bottom of the thin brick or tile. The flat end extends to cover the bottom of the thin brick.

BRIEF DESCRIPTION OF THE DRAWINGS

Embodiments herein will hereinafter be described in conjunction with the appended photos provided to illustrate and not limit the scope of claims, wherein like designations denote like elements, and in which:

DETAILED DESCRIPTION OF THE DRAWINGS

Figure 1:
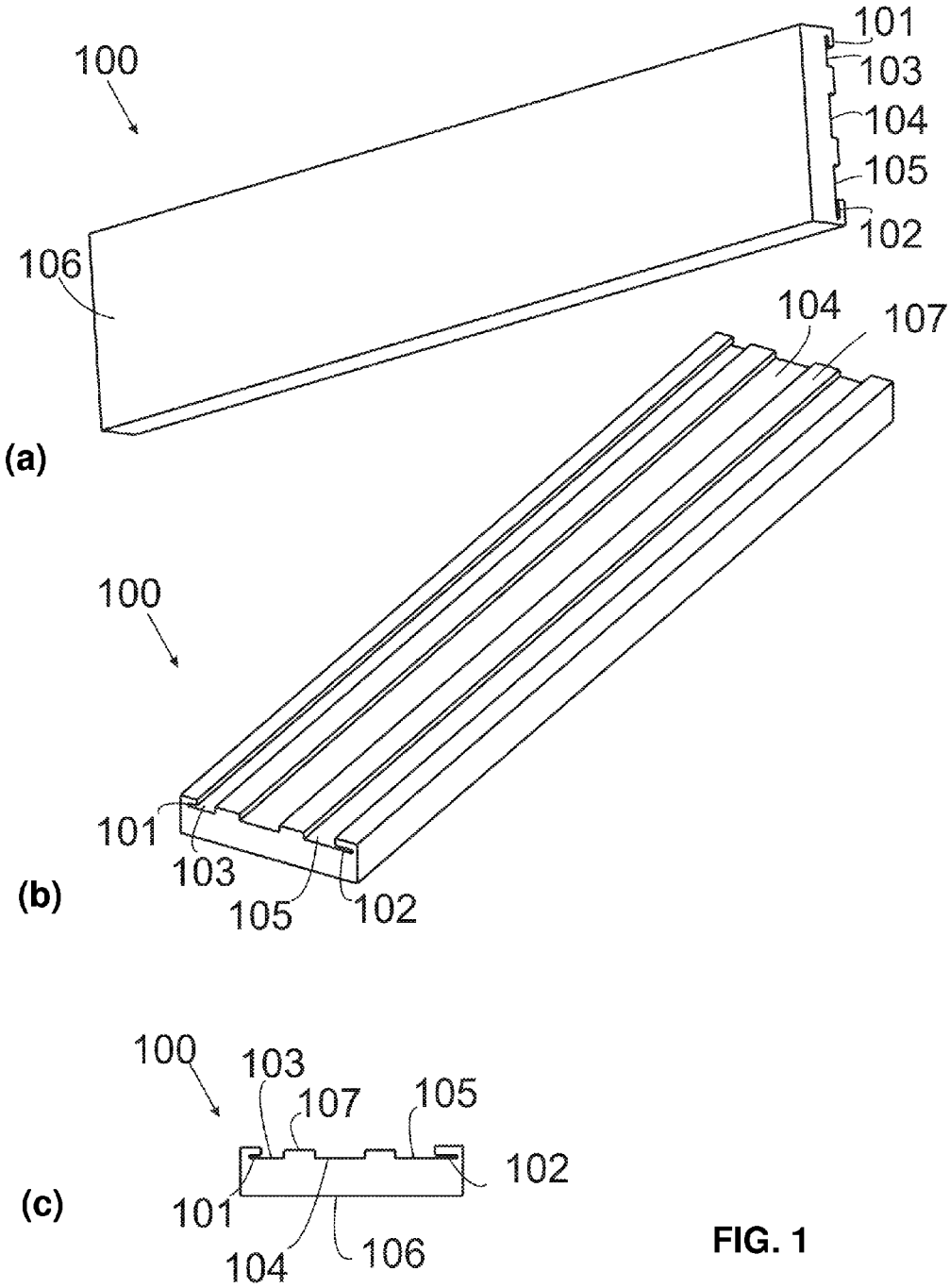
FIG. 1 shows the thin brick that is used in this system.

FIG. 1 shows the specialized design of the thin bricks 100 that allows them to be mechanically attached to the steel panel. FIG. 1*a* shows an isometric view of the front facing 106 side of the brick 100. The front side 106 of the brick is smooth or flat. FIG. 1*b* is an isometric view of the back side 107 of the brick 100. The rear facing side contains three extrusions 103-105. The extrusions 103-105 are shown in a side view in FIG. 1*c*. The top extrusion 103 and the bottom extrusion of the brick 100 contain channels 101-102.

Figure 2:
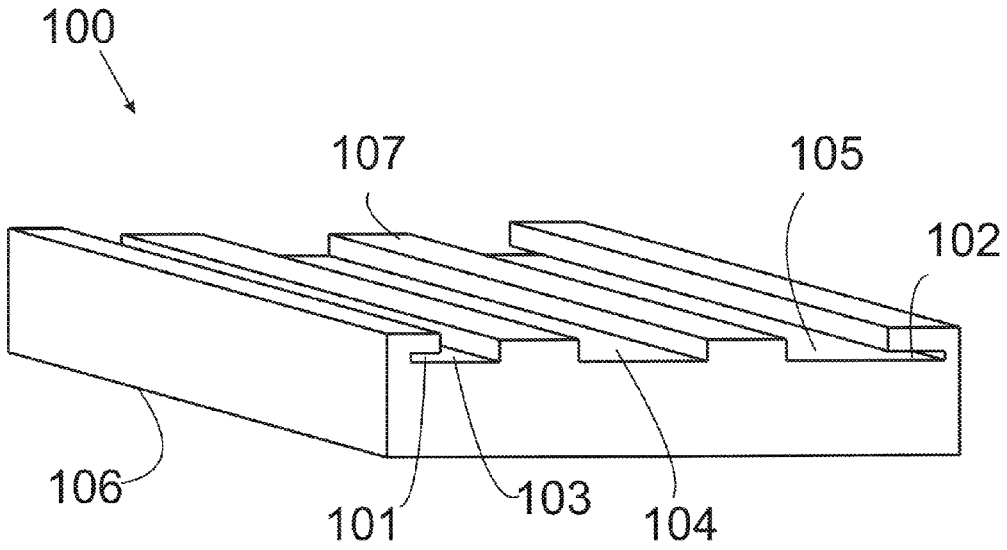
FIG. 2 shows a detailed view of the thin brick and its channels and extrusions.

A detailed view of the specialized bricks 100 is shown in FIG. 2. The top extrusion 103, shown on the left in FIG. 2, contains a channel or groove 101. The bottom extrusion 105, shown on the right in FIG. 2, contains another channel 102. The bottom channel 102 is of a longer length and approximately twice as deep as the top channel 101. The bricks can be made of clay, silica or any similar type of material that can be provide a relatively lightweight façade.

Figure 3:
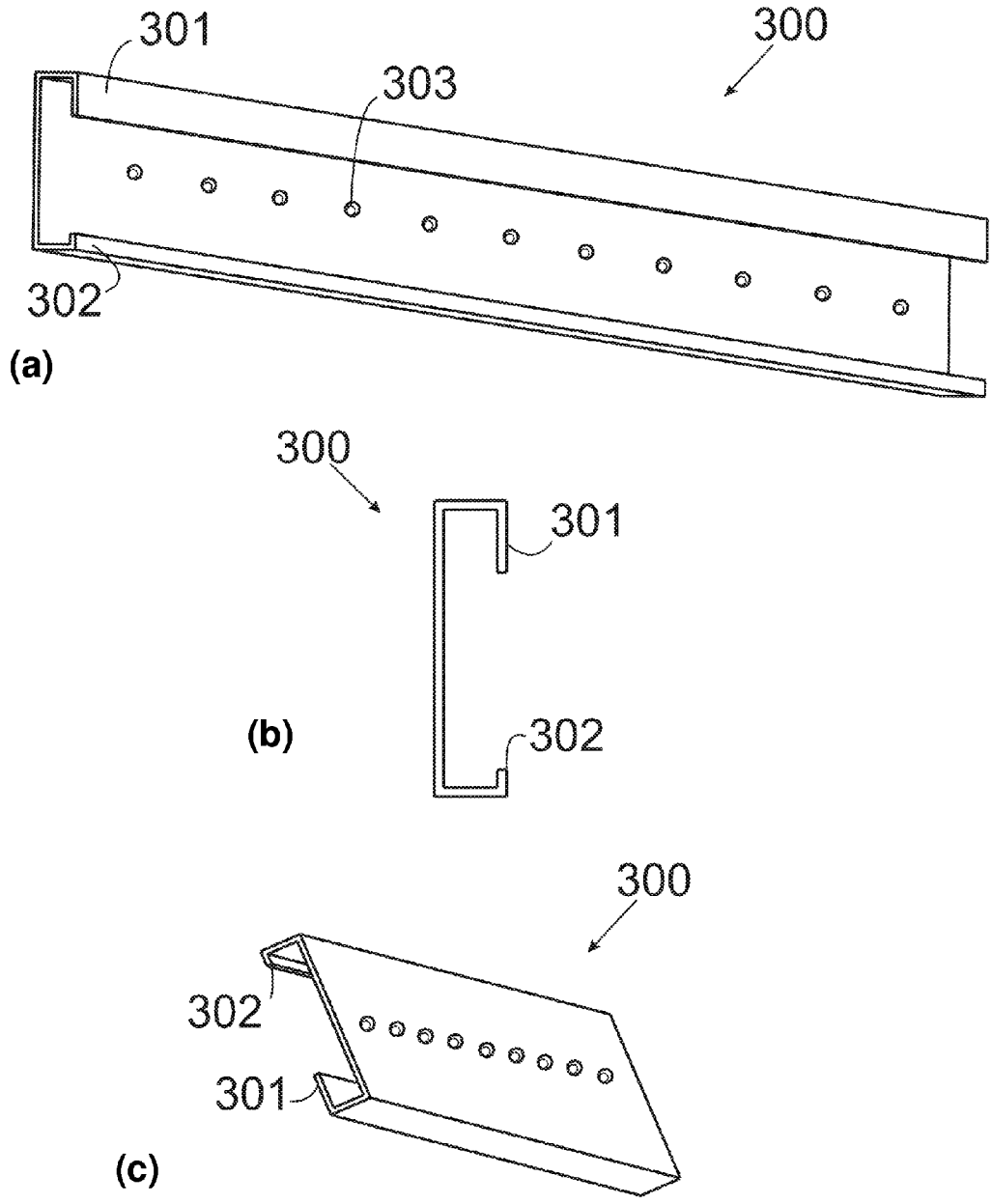
FIG. 3 shows a typical C-bar uses in the present invention.

FIG. 3 shows the design of the C-bars 300 that are used in the present invention. FIG. 3 a shows an isometric view of the C-bar 300. The regular bars 300 are C-shaped with one end 302 being shorter than the other end 301. In the side view and rear isometric views of the C-bar, FIGS. 3*b* and 3*c*, it shows a detailed view of the two ends 301-302 of the C-bar. The shorter end 302 is used to allow space for the brick 100 to move vertically and allow for insertion of the brick 100 onto the panel 300. In the preferred embodiment, the height of the C-bar 300 is 33 mm, the depth of which it extends is 8 mm, the C-shaped panel then bends downward to a length of 3 mm at one end and bends upward to a length of 8 mm at the other. The C-bars 300 contain holes 303 along their length.

Figure 4:
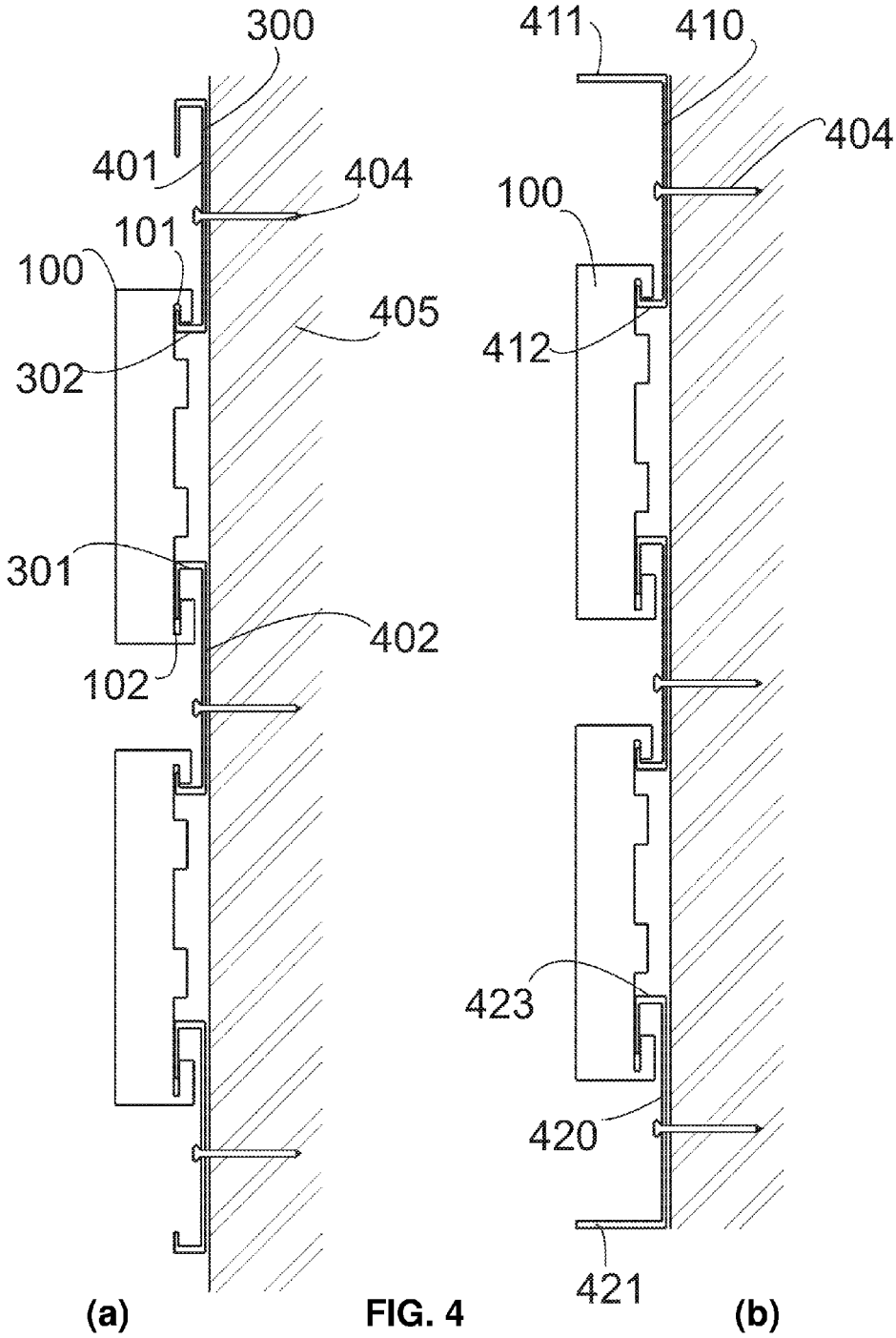
FIG. 4 shows how the bricks and C-bars are form a brick veneer in the present invention.

FIG. 4*a* shows how the bricks 100 are attached to the wall via the C-bar 300. The bricks 100 are attached to the C-bar 300 via the channels 101-102 in the extrusions. A brick 100 is attached at the top channel 101 to the bottom end 302 of the upper C-bar 401 and at its bottom end channel 102 to the top end 301 of the lower C-bar 402. The C-bar 300 is connected to a wooden stud 405 by a nail or screw 404 that is inserted in through one of the holes 303 of the C-bar 300. The wooden studs 405 themselves are connected to the wall by either nails or screws.

FIG. 4*b* shows that there are also C-bars which are used at the top and bottom of the veneer. The end C-bars are modified forms of the regular C-bars. The top end C-bar 410 contains one end 411 which runs straight and perpendicular to the wall and the other end 412 contains regular extension as a regular C-bar. The bottom C-bar 420 contains an end 421 which runs straight and perpendicular to the wall and the other end 423 contains a regular long extension as a regular C-bar.

The preferred embodiment of the end C-bars, 410 and 420, the panels are 24 mm in height. One end extends to a depth of 8 mm and turns downward to a length of a further 8 mm. The opposite end extends to a depth of 12 mm and remains flat.

Figure 5:
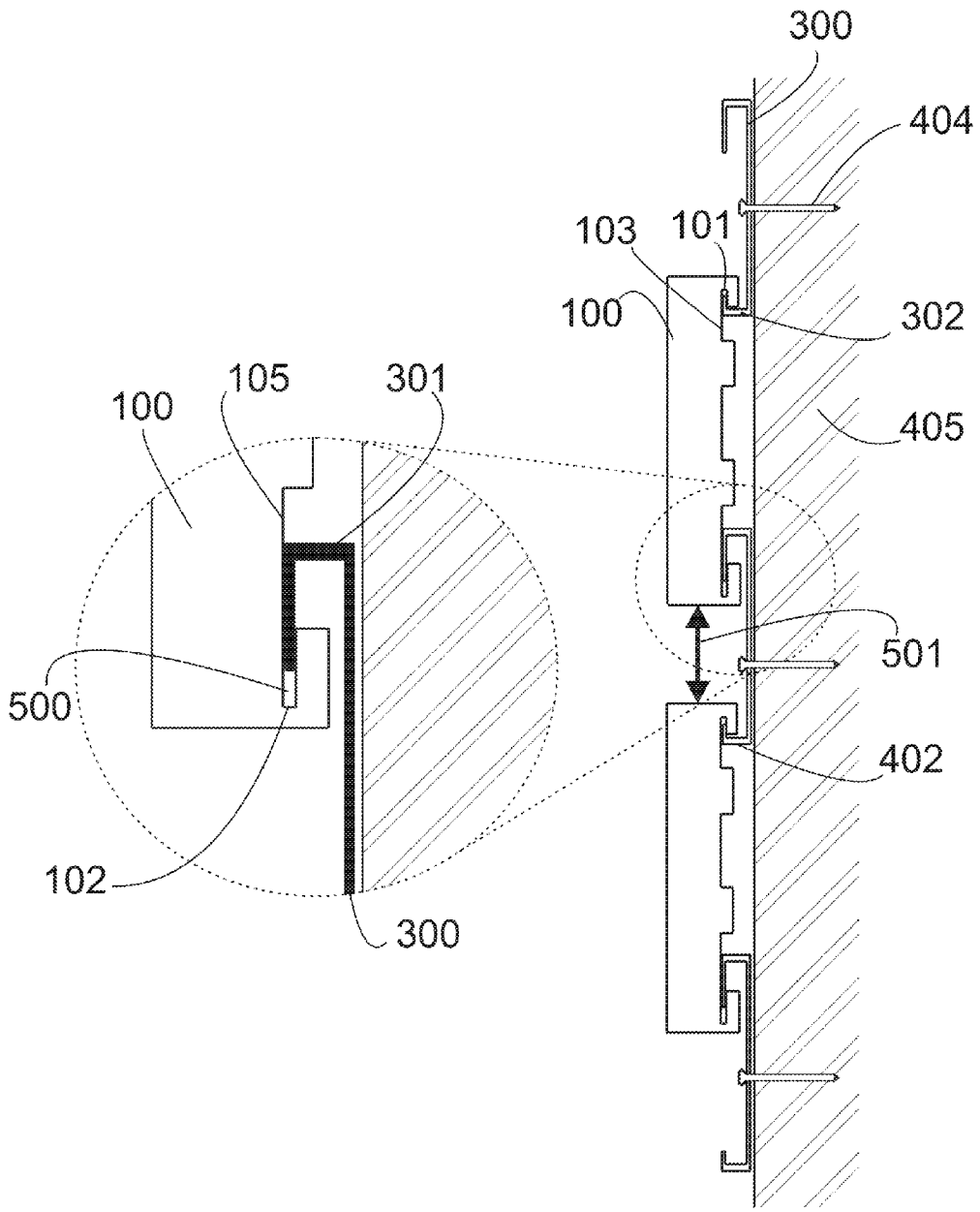
FIG. 5 shows a detailed view of the mechanical attachment mechanism used in the present invention.

FIG. 5 shows a detailed view of brick attaching mechanism. The top extrusion 103 contains a channel 101 that allows for attaching the end 302 of the C-bar 300. The bottom extrusion 105 also contains a channel 102 that allows for attaching an end 301 of the steel panel. The channel 102 in the bottom extrusion 104 is deeper than the channel 101 in the top extrusion 103. This creates a gap 500 which allows for the bottom end 302 of the brick 100 to be attached to the C-bar 300 and be raised for insertion of the C-bar 300 in the top extrusion 103 of the brick 100. When the brick 100 is placed with both the pane ends 301-302 in the respective channels 101-102 of the brick 100 the weight of the brick rests on the top C-bar. The depth of the bottom channel 102 of the brick 100 should extend to such a depth that the gap between the between the C-bar end in the bottom channel should be at least equal to the height of the top anchor 302. Using this method the thin bricks 100 can be attached much more quickly than existing systems.

The design of the panels and bricks allows for a consistently sized even gap 501 between each layer of bricks. The gap or space 501 between the bricks 100 can be filled with cement, mortar or other similar type of building material. The filler will serve to further strengthen the attachment of the bricks 100 to the panel 300 and prevent any vertical motion of the bricks.

Figure 6:
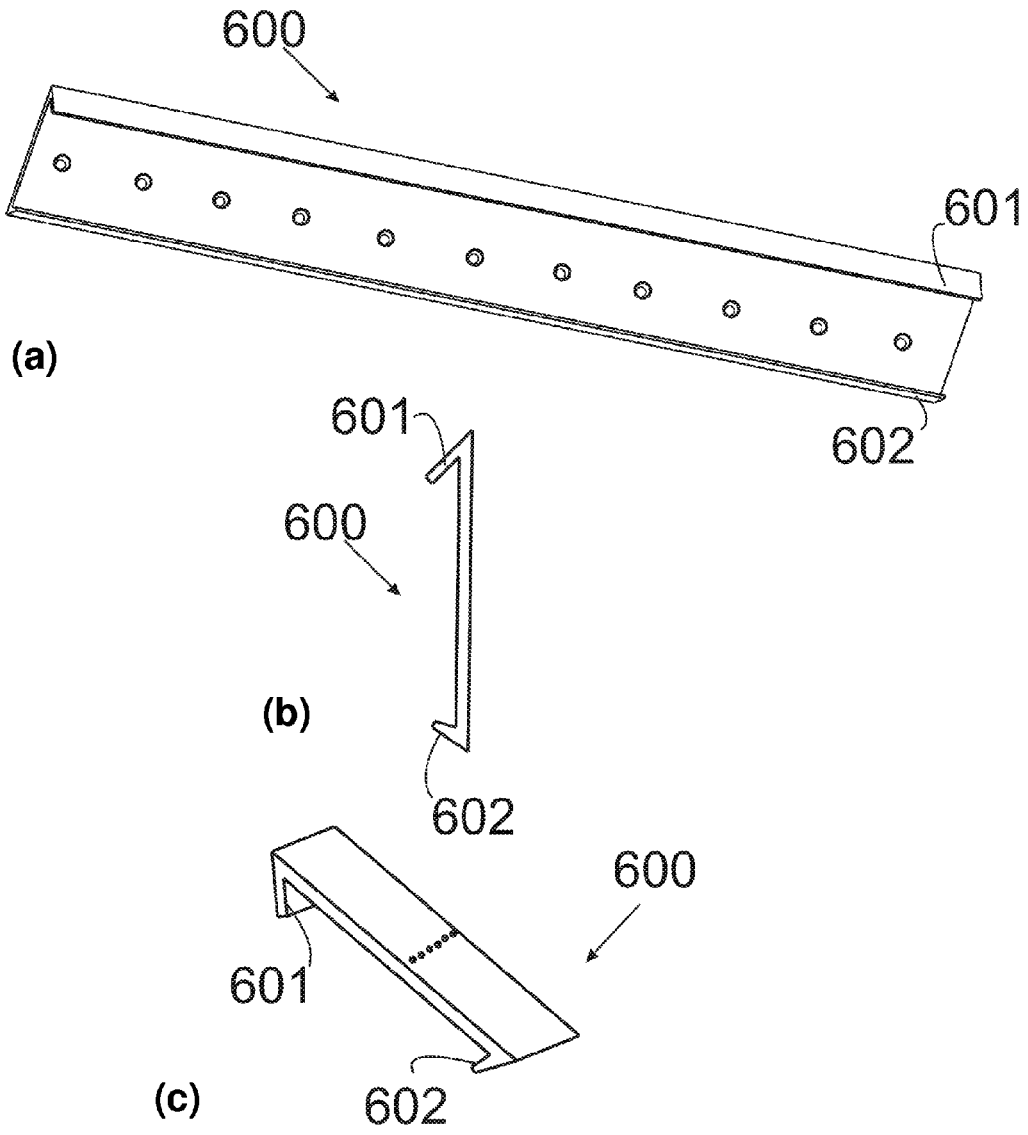
FIG. 6 shows an alternative embodiment of the C-bar to be used for tiles or natural bricks.

Other embodiments of the system include a bar for placing natural stone or tiles. FIG. 6*a* shows an isometric view shows the C-bar 600 for this embodiment. In the side view of the C-bar, FIGS. 6*b* and 6*c*, it shows that the C-bar in this embodiment comprises of angled ends 601-302. On this C-bar 301 the ends 601-602 are angled towards the center at an angle that less than 90 degrees with respect to the wall. As in the previous embodiment the lengths of the ends of C-bar 600 are of differing lengths to allow for a simple and quick mechanical installation. The top end 601 of the angled C-bar 600 is approximately twice as long as the bottom end 602 of the C-bar 600.

Figure 7:
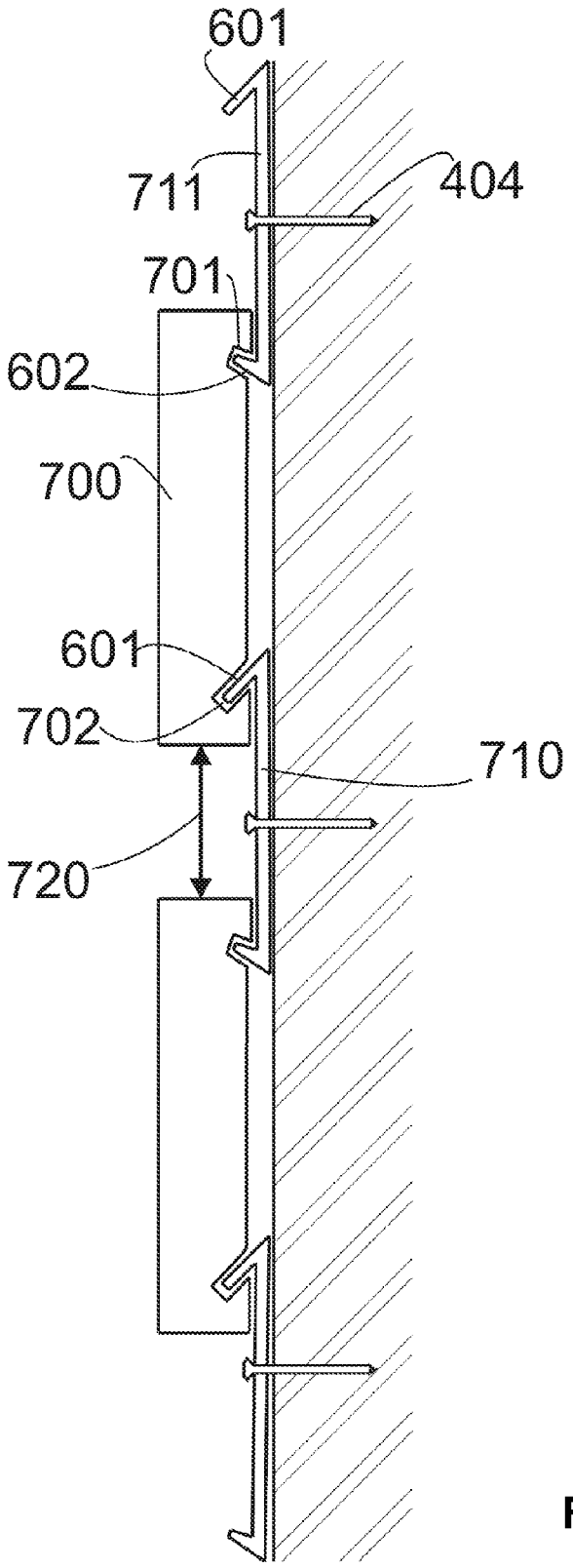
FIG. 7 shows how tiles and natural stone pieces are used in the present invention with the alternative C-bar.

As common materials for making tiles and natural stone are generally more brittle it may be difficult to extrude portions of the tiles and natural stone as is done with the thin bricks 100. The tiles or natural stone pieces 700 and their method of installation is shown in FIG. 7. Tiles or natural stone pieces 700 contain two channels 701-702 for housing the ends of the angled C-bar 600. The top channel 701 of the tile or natural stone 700 is less deep than the channel found on the bottom end 702 of the natural stone or tile 700. This allows the tiles and natural stone 700 pieces to be quickly inserted. The method of installation consists of aligning and inserting the bottom channel of the tile 702 with the top end 601 of the lower C-bar 710. Since the lower channel 702 of the tile is longer than the length of the C-bar end 602 it allows for the tile to be shifted up and for the top channel of the tile 701 to be aligned with and allow for insertion of the bottom end 602 of the upper C-bar 711. Once all tiles are installed using this method the gaps 720 between the individual tiles and natural stone 600 are filled in with grout or similar material which further secures them to the surface.

Figure 8:
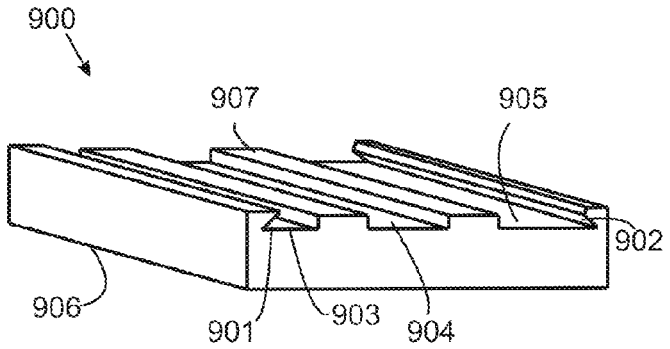
FIG. 8 shows an alternate embodiment of thin brick installation.
Figure 8:
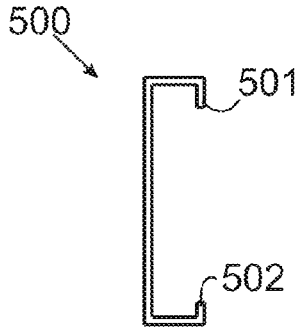
Figure 8:
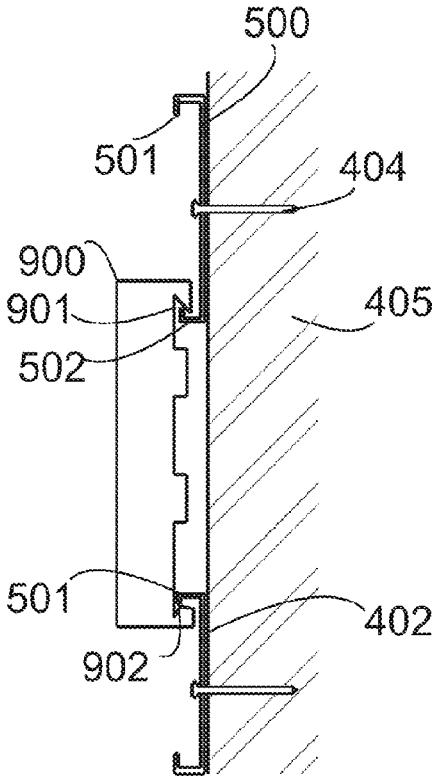

FIG. 8 shows an alternative embodiment of the bricks and C-bar. The bricks 900, as shown in FIG. 8*a*, contain one end 901 that is the angled downward and a second end 902 that angled but also cut off. In this embodiment, the ends 501-502 of the C-bar 500 are of equal length, as shown in FIG. 8*b*.

FIG. 8*c* shows that installation occurs by placing the top end of the brick 801 on the bottom end 812 of the C-bar 810 and then pressing the bottom end 802 of the brick to the top end of the second C-bar 810 until the brick is secured.

Figure 9:
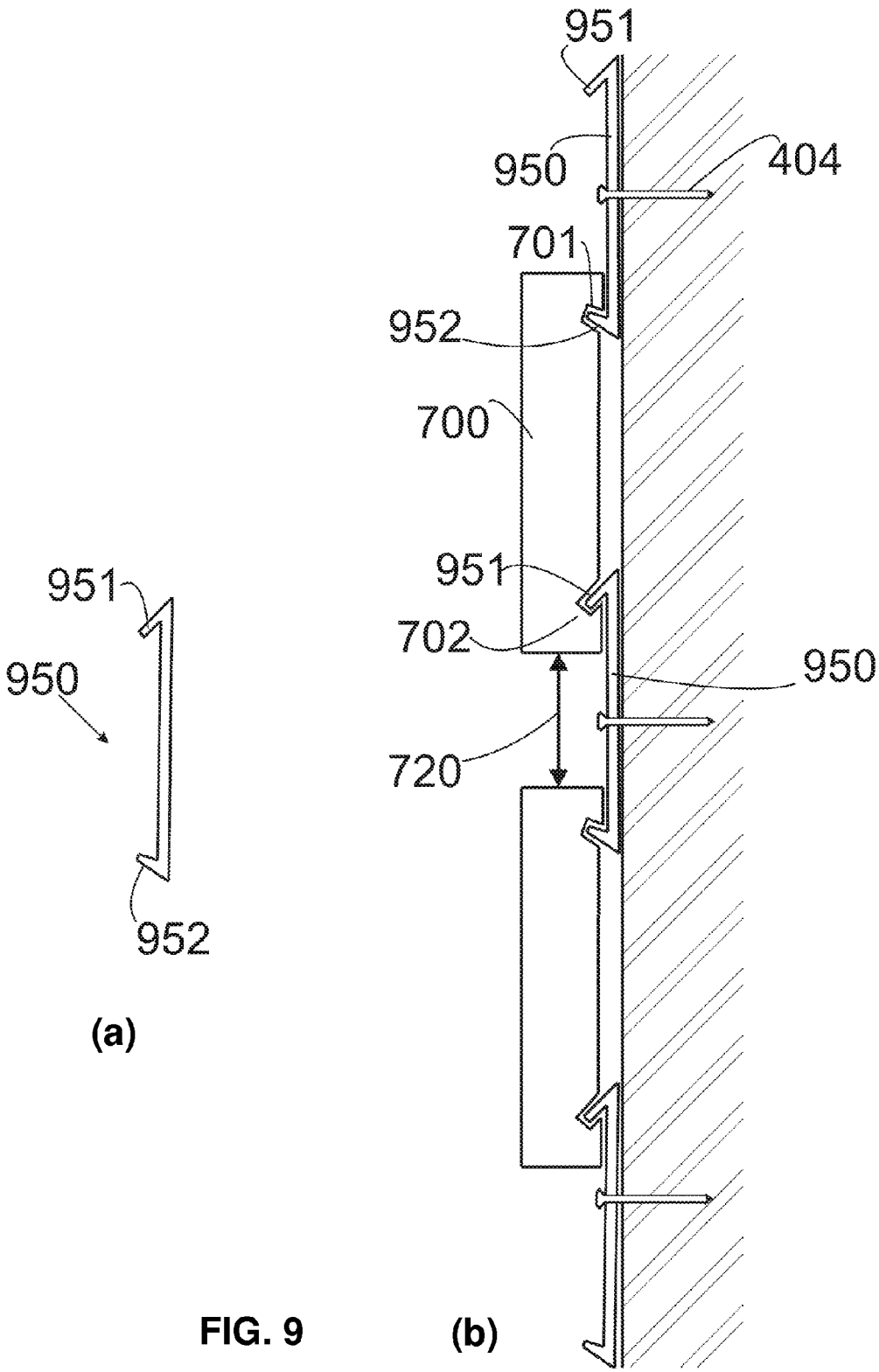
FIG. 9 shows an alternate embodiment of natural stone installation.

Natural stone can also be installed using an alternative method. The C-bar 915, shown in FIG. 9*a*, contains ends that are angled 911-912 but of equal length. The natural stone tile 700 contains channels 701-702 as previously but of equal length. In FIG. 9*b*, installed natural stone tile is shown. Installation is shown in FIG. 9*c*, a natural stone tile 700 is placed pat either the left or right end of the C-bars 950-951 and is moved horizontally toward the desired position. A gap 720 remains between the tiles which can be later filled with grout or other filling material as in the previous embodiment.

Figure 10:
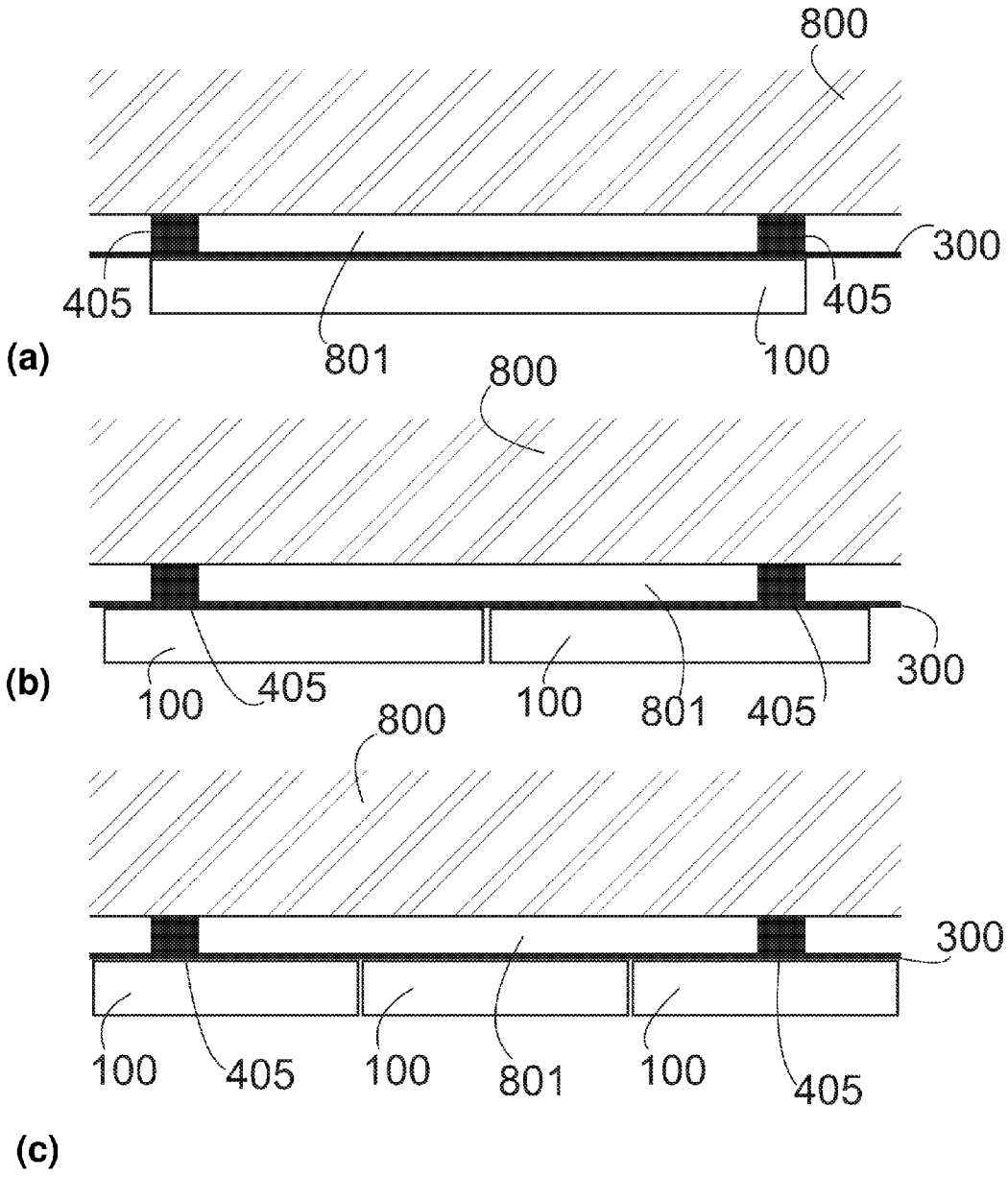
FIG. 10 shows an overhead view of the fully system in the present invention.

FIG. 10 shows an overhead view of the system. The brick veneer system can be assembled on a plywood board wall 800 or any other type of existing wall surface. The veneer system is supported by wooden studs 405 which are nailed, screwed or otherwise fastened to the pre-existing wall. Steel C-bars 300 are then attached to the wooden studs 405 and fastened to the studs using nails or screws. The thin bricks 100 are then mechanically attached to the C-bar 300. The gap 801 between the wall and the C-bars 300 can be used as a water channel in order to prevent leaking, or in other cases, it can be filled with foam insulation. The length between the wooden studs 405 and the length of the bricks 100 can vary so that a single brick 100 or multiple bricks may span the length between the wooden studs 405 as is shown in FIG. 10*a-c*.

The forgoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A brick veneer system comprising:

a. a brick having a substantially rectangular brick body, said brick body comprising of a front face, a back face, a top face, and a bottom face, said top face extending beyond said back face forming a downward facing longitudinal groove at the back face of the brick, said bottom face extending beyond said back face forming an upward facing longitudinal groove at the back face of the brick;

b. a first longitudinal panel having a first top side, a first bottom side and a first L-shaped bracket on each of said first top and first bottom sides to receive said bricks;

c. a second longitudinal panel having a second top side, a second bottom side and a second L-shaped bracket on each of said second top and second bottom sides to receive said bricks;

d. said downward facing longitudinal groove and said upward facing longitudinal groove being engaged with said first bottom and second top L-shaped brackets respectively; and whereby said panel being horizontally and longitudinally attached to a wall.

2. The brick veneer system of claim 1, wherein material of said bricks, being selected from the groups consisting of a clay, a plastic, and a natural stone.

3. The brick veneer system of claim 1, wherein material of said panel, being selected from the groups consisting of a stainless steel, and a plastic.

4. The brick veneer system of claim 1, wherein said longitudinal grooves having equal or unequal depth.

5. The brick veneer system of claim 1, wherein said L-shaped bracket having equal or unequal length.

6. A brick veneer system comprising:

a. a brick having a substantially rectangular brick body, said brick body comprising of a front face, a back face, a top face, a bottom face, a right face, and a left face, wherein said back face having a top acutely angled groove being located near said top face extending between said right face and said left face and a bottom acutely angled groove being located near said bottom face extending between said right face and said left face;

b. a first longitudinal panel having a first front face, a first back face, a first top end, a first bottom end, a first acutely angled top bracket extending from said first front face at first top end, and a first acutely angled bottom bracket extending from said first front face at first bottom end to receive said bricks;

c. a second longitudinal panel having a second front face, a second back face, a second top end, a second bottom end, a second acutely angled top bracket extending from said second front face at second top end, and a second acutely angled bottom bracket extending from said second front face at second bottom end to receive said bricks;

d. said top acutely angled groove and said bottom acutely angled groove being engaged with said first acutely angled bottom bracket and said second acutely angled top bracket respectively; and whereby said panel being horizontally and longitudinally attached to a wall.

7. The brick veneer system of claim 6, wherein material of said bricks, being selected from the groups consisting of a clay, a plastic, and a natural stone.

8. The brick veneer system of claim 6, wherein material of said panel, being selected from the groups consisting of a stainless steel, and a plastic.

9. The brick veneer system of claim 6, wherein said acutely angled grooves having equal or unequal depth.

10. The brick veneer system of claim 6, wherein said acutely angled bracket having equal or unequal length.

* * * * *